US008502125B2

(12) United States Patent
Danzer et al.

(10) Patent No.: US 8,502,125 B2
(45) Date of Patent: Aug. 6, 2013

(54) MICROWAVE OVEN DOOR WITH A WAVES CHOKES SYSTEM

(75) Inventors: Norbert Danzer, Gebstattel (DE); Abdel-llah Zbat, Wurzburg (DE); Martin Gasch, Rothenburg (DE); Arnd Hofmann, Lulsfeld (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 304 days.

(21) Appl. No.: 12/675,437

(22) PCT Filed: Jul. 30, 2008

(86) PCT No.: PCT/EP2008/006277

§ 371 (c)(1),
(2), (4) Date: Feb. 26, 2010

(87) PCT Pub. No.: WO2009/030321

PCT Pub. Date: Mar. 12, 2009

(65) Prior Publication Data

US 2010/0308034 A1 Dec. 9, 2010

(30) Foreign Application Priority Data

Sep. 3, 2007 (EP) ..... 07017203

(51) Int. Cl.
*H05B 6/76* (2006.01)

(52) U.S. Cl.
USPC ..... 219/738; 219/739; 219/740; 219/741; 219/742

(58) Field of Classification Search
USPC ..... 219/736–743
See application file for complete search history.

(56) References Cited

U.S. PATENT DOCUMENTS

| | | | | |
|---|---|---|---|---|
| 3,584,177 | A | 6/1971 | Bucksbaum | |
| 3,843,859 | A | 10/1974 | Klemp et al. | |
| 4,102,041 | A * | 7/1978 | Copping et al. | 29/600 |
| 4,584,447 | A * | 4/1986 | Kusunoki et al. | 219/742 |
| 4,711,982 | A | 12/1987 | Millman | |
| 4,742,201 | A * | 5/1988 | Nakano et al. | 219/742 |
| 4,794,218 | A * | 12/1988 | Nakano et al. | 219/743 |
| 5,206,478 | A * | 4/1993 | Lee | 219/742 |
| 5,705,797 | A * | 1/1998 | Seo | 219/742 |
| 5,789,724 | A * | 8/1998 | Lerssen et al. | 219/741 |
| 5,824,999 | A * | 10/1998 | Kim et al. | 219/742 |
| 6,927,374 | B2 * | 8/2005 | Hu et al. | 219/742 |

(Continued)

OTHER PUBLICATIONS

International Search Report of PCT/EP2008/006277 dated Oct. 10, 2008.

*Primary Examiner* — Ngan Ngo
(74) *Attorney, Agent, or Firm* — Workman Nydegger

(57) ABSTRACT

The present invention relates to an oven door with a wave chokes system for a microwave oven. The oven door includes at least one transparent door panel made of a dielectric material and a metallization enclosing at least partially the transparent door panel. The oven door includes further a plurality of lamellae arranged uniformly on one side of the metallization and at least one front shielding, which is arranged in the center portion on at least one side of the transparent door panel. The metallization and the lamellae are formed by a coating on the transparent door panel, wherein said coating is made of a conductive material and applied on the transparent door panel. Further, the present invention relates to a corresponding microwave oven. Additionally, the present invention relates to a method for manufacturing an oven door with a wave chokes system for a microwave oven.

16 Claims, 1 Drawing Sheet

U.S. PATENT DOCUMENTS

| | | | | |
|---|---|---|---|---|
| 6,956,191 | B2 * | 10/2005 | Han et al. | 219/685 |
| 7,022,957 | B2 * | 4/2006 | Bakanowski et al. | 219/741 |
| 2004/0031792 | A1 * | 2/2004 | Han et al. | 219/739 |
| 2005/0023277 | A1 * | 2/2005 | Kim et al. | 219/739 |
| 2005/0056639 | A1 * | 3/2005 | Hu et al. | 219/739 |

* cited by examiner

MICROWAVE OVEN DOOR WITH A WAVES CHOKES SYSTEM

BACKGROUND OF THE INVENTION

1. Field of the Invention

The present invention relates to an oven door with a wave chokes system for a microwave oven. Further, the present invention relates to a microwave oven. Additionally, the present invention relates to a method for manufacturing an oven door with a wave chokes system for a microwave oven.

2. Background and Relevant Art

A microwave oven generates strong electromagnetic fields in order to heat the food stuff. Said electromagnetic fields are potential threat to the health of the operator, if the electromagnetic fields or parts of them leave the cavity. The door of the microwave oven is critical. In particular, the microwaves may leave the cavity through the gap between the door and the cavity.

The gap between the door and the cavity is sealed with respect to microwaves by integrating a wave chokes system into the door of the microwave oven. Said wave chokes systems provide a small band stop by a cascaded $\lambda/4$-transformation. However, the oven door with the wave chokes system is a complex apparatus and requires a costly manufacturing.

BRIEF SUMMARY OF THE INVENTION

It is an object of the present invention to provide an oven door with a wave chokes system for a microwave oven, which has a compact structure and can be easily manufactured. It is further an object of the present invention to provide a method for manufacturing such an oven door.

This object is achieved by the oven door according to claim 1.

According to the present invention the metallization and the lamellae are formed by a coating on the transparent door panel, wherein said coating is made of a conductive material and applied on the transparent door panel. The main idea of the invention is that some of the conductive parts of the oven door are formed as the coating of the conductive material on the dielectric transparent door panel. This allows a very compact construction of the oven door. The oven door can be easily manufactured. The oven door comprises small surfaces, so that it is easy for the user to clean the oven door.

Preferably the front shielding is formed by the coating on the transparent door panel. This is an addition option to simplify the manufacturing of the oven door.

Further, the front shielding comprises a plurality of holes with a diameter smaller than the wavelength of the microwaves. This allows on the one hand that the oven door is optically transparent and the user can look into the cavity. On the other hand the front shielding holds back the microwaves.

The invention allows that the coating comprises a perforation. By the selection of the perforation, certain physical, geometric and aesthetic properties of the oven door may be chosen.

The coating may be made of metal. The transparent door panel is made of a glass, glass ceramics or plastics.

The invention relates further to a microwave oven, which comprises an oven door as described above.

This object of the present invention is further achieved by the method according to claim 10.

The method for manufacturing an oven door with a wave chokes system for a microwave oven comprises the following steps:

providing at least one transparent door panel made of a dielectric material, and applying a coating made of a conductive material onto the transparent door panel according to a predetermined scheme, so that a metallization encloses at least partially the transparent door panel, a plurality of lamellae are arranged, preferably uniformly, on one side of said the metallization, and at least one front shielding is arranged in the centre portion on at least one side of the transparent door panel.

Preferably, the coating is applied onto the transparent door panel by metallization, in particular by vaporization. This allows manufacturing a very compact construction of the oven door.

The novel and inventive features believed to be the characteristic of the present invention are set forth in the appended claims.

BRIEF DESCRIPTION OF THE DRAWINGS

The invention will be described in further detail with reference to the drawing, in which.

DETAILED DESCRIPTION OF THE PREFERRED EMBODIMENTS

Figure 1:
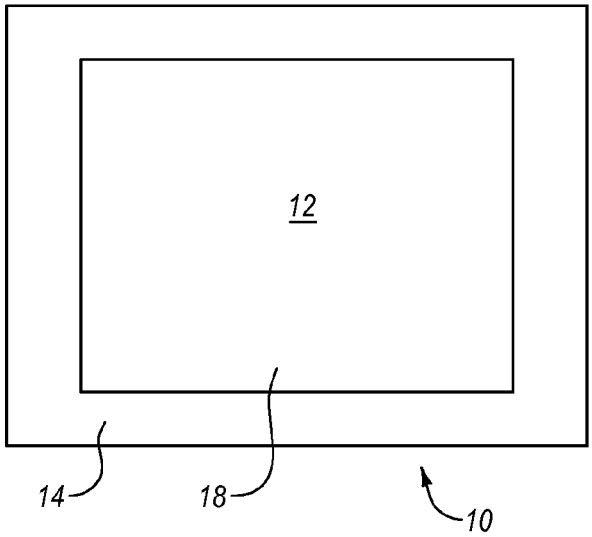
FIG. 1 illustrates a schematic front view of an oven door according to a preferred embodiment of the present invention.

FIG. 1 illustrates a schematic front view of an oven door 10 according to a preferred embodiment of the present invention. The oven door 10 comprises a transparent door panel 12 and a metallization 14.

The transparent door panel 12 is made of a dielectric material, such as glass, glass ceramic or plastics. The metallization 14 is applied onto the transparent door panel 12. The metallization 14 may be applied on one side of the transparent door panel 12 or encompasses the outer portion of the transparent door panel 12. In the latter case the metallization 14 has a U-shaped cross section. In this shown example the metallization 14 encompasses the outer portion of the transparent door panel 12 and has a U-shaped cross section. The metallization 14 forms conductive sheets, which are applied onto the transparent door panel 12. The conductive sheets are made of a coating, which has been applied onto the transparent door panel 12. The outer portion of the transparent door panel 12 comprises a coating, which forms the metallization 14. The metallization 14 is a conductor enclosing the transparent door panel 12.

In the centre portion of the outer side of the transparent door panel 12 there is front shielding 18. The front shielding 18 is also made of a coating, which has been applied onto the transparent door panel 12. The coating for the front shielding 18 is also made of a conductive material. The structure of the front shielding 18 is formed in such a way, that the front shielding 18 is optically transparent on the one hand, but not transparent for the microwaves on the other hand. The front shielding 18 may be realized by a coating with a plurality of small holes. The diameter of said hole must be smaller than the wave length of the microwave.

The coating may be applied onto the transparent door panel 12 by vapor deposition. The material of the coating may be metal. The transparent door panel 12 and an applied conductive coating allow a simple manufacturing of the oven door 10 comprising the metallization 14 with the lamellae 16 and the front shielding 18.

Figure 2:
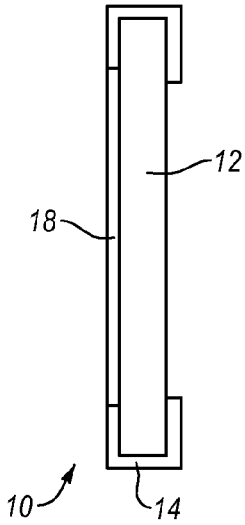
FIG. 2 illustrates a schematic side view of the oven door according to the preferred embodiment of the present invention.

In FIG. 2 a schematic side view of the oven door 10 according to the preferred embodiment of the present invention is shown. On the centre portion of the outer side of the transparent door panel 12 the front shielding 18 is applied. On the outer portion of both sides of the transparent door panel 12 the metallization 14 is applied.

Figure 3:
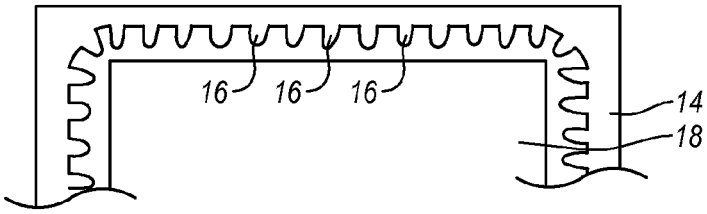
FIG. 3 illustrates a schematic partial view of an inner side of the oven door according to the preferred embodiment of the present invention.

FIG. 3 illustrates a schematic partial view of an inner side of the oven door 10 according to the preferred embodiment of the present invention. The metallization 14 is on its inner side not completely bordered by the conductive coating. The conductive coating comprises a plurality of lamellae 16 on its inner side. In this example the lamellae 16 are arranged serially within the complete metallization 14, which extends along the circumference.

Alternatively, the lamellae 16 may be arranged only on critical portions of the inner side of the metallization 14.

The wave chokes device according to the present invention allows a simple manufacturing and a modular setup of the oven door 10. The designer of the microwave oven has more options for the design of the oven door 10. The inventive oven door 10 allows a smooth surface, so that the cleaning of the microwave oven is easy.

Although illustrative embodiments of the present invention have been described herein with reference to the accompanying drawing, it is to be understood that the present invention is not limited to those precise embodiments and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 oven door
12 transparent door panel
14 metallization of the door panel
16 lamella
18 front shielding

The invention claimed is:

1. An oven door with a wave chokes system for a microwave oven, which oven door comprises:
- at least one transparent door panel made of a dielectric material;
- a metallization coating enclosing at least partially the transparent door panel;
- a plurality of lamellae arranged, in particular uniformly, on one side of the metallization; and
- at least one front shielding, which is arranged in the centre portion on at least one side of the transparent door panel, wherein the metallization coating and the lamellae are formed by a coating applied to the transparent door panel, wherein said coating is made of a conductive material and applied on the transparent door panel.

2. The oven door according to claim 1, wherein the front shielding is formed by the coating on the transparent door panel.

3. The oven door according to claim 2, wherein the front shielding comprises a plurality of holes with a diameter smaller than the wavelength of the microwaves.

4. The oven door according to claim 3, wherein the coating comprises a perforation.

5. The oven door according claim 4, wherein the coating is made of metal.

6. The oven door according to claim 4, wherein the transparent door panel is made of a glass.

7. The oven door according to claim 4, wherein the transparent door panel is made of a glass ceramics.

8. The oven door according to claim 4, wherein the transparent door panel is made of a plastic.

9. A method for manufacturing an oven door with a wave chokes system for a microwave oven, comprising:
- providing at least one transparent door panel made of a dielectric material; and
- applying a coating made of a conductive material onto the transparent door panel according to a predetermined scheme, wherein:
  - a metallization is formed on the outer portion of the transparent door panel, which encloses at least partially the transparent door panel;
  - a plurality of lamellae are arranged, in particular uniformly, on one side of said the metallization; and
  - at least one front shielding is arranged in the centre portion on at least one side of the transparent door panel.

10. The method according to claim 9, wherein the coating is applied onto the transparent door panel by metallization, in particular by vaporization.

11. The method according to claim 9, wherein the at least one front shielding is formed by the coating on the transparent door panel.

12. The method according to claim 11, wherein the front shielding comprises a plurality of holes with a diameter smaller than the wavelength of the microwaves.

13. The method according to claim 12, wherein the coating comprises a perforation.

14. A microwave oven comprising a substantially flush oven door having a wave chokes system, wherein the oven door comprises:
- at least one transparent door panel made of a dielectric material;
- a metallization coating enclosing at least partially the transparent door panel;
- a plurality of lamellae arranged, in particular uniformly, on one side of the metallization coating; and
- at least one front shielding, which is arranged in the centre portion on at least one side of the transparent door panel, wherein the metallization coating and the lamellae are formed by a coating applied to the transparent door panel, wherein said coating is made of a conductive material and applied on the transparent door panel, and wherein the lamellae are integrated with the metallization coating.

15. The microwave oven as recited in claim 14, wherein the at least one front shielding and the metallization coating together form a smooth surface of an outer side of the substantially flush oven door.

16. The microwave oven as recited in claim 14, wherein the at least one front shielding and the metallization coating together form a smooth surface of an inner side of the substantially flush oven door.

* * * * *

UNITED STATES PATENT AND TRADEMARK OFFICE

CERTIFICATE OF CORRECTION

PATENT NO. : 8,502,125 B2
APPLICATION NO. : 12/675437
DATED : August 6, 2013
INVENTOR(S) : Danzer et al.

It is certified that error appears in the above-identified patent and that said Letters Patent is hereby corrected as shown below:

On the Title Page, Item (54) and in the Specifications, Column 1, Line 1, title, change
"MICROWAVE OVEN DOOR WITH A WAVES CHOKES SYSTEM" to
--MICROWAVE OVEN DOOR WITH A WAVE CHOKES SYSTEM--

In the Specifications

Column 1

Line 15, change "fields are potential threat" to --fields are a potential threat--
Line 26, change "requires a costly manufacturing" to --requires costly manufacturing--
Line 48, change "an addition option" to --an additional option--

Column 2

Line 9, change "said the metallization" to --said metallization--
Line 14, change "allows manufacturing" to --allows for the manufacture of--
Line 67, change "wave length" to --wavelength--

Signed and Sealed this
Third Day of December, 2013

Margaret A. Focarino

Margaret A. Focarino
*Commissioner for Patents of the United States Patent and Trademark Office*